US006647903B2

(12) United States Patent
Ellis

(10) Patent No.: US 6,647,903 B2
(45) Date of Patent: Nov. 18, 2003

(54) METHOD AND APPARATUS FOR GENERATING AND UTILIZING COMBUSTIBLE GAS

(76) Inventor: Charles W. Aguadas Ellis, P.O. Box 7137, Boulder, CO (US) 80306

( * ) Notice: Subject to any disclaimer, the term of this patent is extended or adjusted under 35 U.S.C. 154(b) by 0 days.

(21) Appl. No.: 09/954,592

(22) Filed: Sep. 14, 2001

(65) Prior Publication Data

US 2002/0069798 A1 Jun. 13, 2002

Related U.S. Application Data

(60) Provisional application No. 60/232,642, filed on Sep. 14, 2000.

(51) Int. Cl.[7] ..... F23L 7/00; F23B 7/00; C10J 3/00

(52) U.S. Cl. ..... 110/348; 110/342; 110/229; 110/233; 110/248; 110/301; 110/297; 48/203

(58) Field of Search ..... 110/215, 229, 110/233, 248, 297, 301, 302, 303, 306, 312, 313, 342, 345, 348; 48/197 A, 199 FM, 203, 197 FM, DIG. 8

(56) References Cited

U.S. PATENT DOCUMENTS 3,520,649 A * 7/1970 Tomany et al. ..... 23/2
4,184,437 A * 1/1980 Mallek et al. ..... 110/251
4,191,114 A * 3/1980 Saitoh et al. ..... 110/248
4,213,404 A * 7/1980 Spaulding ..... 110/229
4,278,064 A * 7/1981 Regueiro ..... 123/577
4,463,686 A * 8/1984 Premel ..... 110/165 R
4,498,909 A * 2/1985 Milner et al. ..... 48/209
4,599,953 A * 7/1986 Gould ..... 110/234
4,643,110 A * 2/1987 Lisowyj et al. ..... 110/229
4,655,968 A * 4/1987 Queiser et al. ..... 252/632
4,750,437 A * 6/1988 Rouse ..... 110/346
4,881,949 A * 11/1989 Brungel et al. ..... 48/197 R
5,226,927 A * 7/1993 Rundstrom
5,279,234 A * 1/1994 Bender et al. ..... 110/210
5,311,830 A * 5/1994 Kiss ..... 110/346
5,318,602 A * 6/1994 Juch ..... 48/76
5,553,556 A * 9/1996 Kruger ..... 110/345
6,024,032 A * 2/2000 Sharpe ..... 110/342
6,182,584 B1 * 2/2001 Gaudio ..... 110/229
6,202,577 B1 * 3/2001 Boguslavsky et al. ..... 110/346
6,279,491 B1 * 8/2001 Takahashi et al. ..... 110/345
6,283,048 B1 * 9/2001 Fujinami et al. ..... 110/346
6,360,679 B1 * 3/2002 Clarke ..... 110/342

OTHER PUBLICATIONS

Bui, T., Loof, R., and Bhattacharya, S.C., "Multi–stage Reactor for Thermal Gasification of Wood," *Energy* vol. 19, No. 4, Elsevier, 1994, pp. 397–404.

Gumz, W., Fig. 2.6, Gas composition vs. temperature in a gas producer, from Gumz, W., *Gas Producers and Blast Furnaces*, Wiley, New York (1950), adapted from W. Horak, *Z. Oester Ver. Gas–u. Wasserfachm*, 74, No. 11–12, 1933, pp. 170–180.

Makunda, H.S., Dasappa, S., Paul, P.I., Rajan, N.K.S., and Shrinivasa, U., "Gasifiers and combustors for biomass–technology and field studies," *Energy for Sustainable Development* vol. 1, No. 3, Sep. 1994, pp. 27–38.

Reed, T.B. and A. Das, "Chapter 2: History, Current developments, and Future Directions," *Handbook of Biomass Downdraft Gasifier Engine Systems*, Solar Energy Research Institute, Golden, Colorado (Now National Renewable Energy Laboratory), Document No. SERI/SP–271–3022, DE88001135, Mar. 1988, UC Category: 245, pp. 6–8.

Reed, T.B. and A. Das, "Chapter 4," *Handbook of Biomass Downdraft Gasifier Engine Systems*, Solar Energy Research Institute, Golden, Colorado (Now National Renewable Energy Laboratory), Document No. SERI/SP–271–3022, DE88001135, Mar. 1988, UC Category: 245, p. 22.

Reed, T.B. and A. Das, "Chapter 5: Gasifier Designs," *Handbook of Biomass Downdraft Gasifier Engine Systems*, Solar Energy Research Institute, Golden, Colorado (Now National Renewable Energy Laboratory), Document No. SERI/SP–271–3022, DE88001135, Mar. 1988, UC Category: 245, pp. 30–47.

* cited by examiner

*Primary Examiner*—Ira S. Lazarus
*Assistant Examiner*—K. B. Rinehart
(74) *Attorney, Agent, or Firm*—Marian J. Furst, Attorney at Law; Marian J. Furst

(57) ABSTRACT

Apparatus and method for generating fuel gas and optionally, activated carbon gasification from biomass fuel.

29 Claims, 10 Drawing Sheets

METHOD AND APPARATUS FOR GENERATING AND UTILIZING COMBUSTIBLE GAS

CROSS REFERENCE TO RELATED APPLICATION

This application claims priority to copending U.S. provisional patent application Serial No. 60/232,642, filed Sep. 14, 2000, entitled, "Method and Apparatus for Controlling and Utilizing Combustible Gas," which is incorporated herein in its entirety.

BACKGROUND

1. Field of the Invention

The present invention relates generally to the field of biomass gasifiers, and more particularly to biomass gasifiers producing combustible gases with low tar contents as needed for as needed for running internal combustion engines.

2. Description of Related Art

A variety of systems are known for combusting biomass materials to generate heat and power. Three classes of gasifiers are common in the prior art: updraft gasifiers, downdraft gasifiers with nozzles for air injection, and downdraft gasifiers without air injection nozzles.

In updraft or countercurrent systems, combustion air enters below the char bed, and fuel enters at the top. The combustion air first encounters ash and glowing char. Oxygen within the combustion air is consumed. The char bed temperature reaches its peak at the point downstream where the oxygen is generally completely consumed. Hot gaseous combustion products, primarily $CO_2$ and $H_2O$, react endothermically at temperatures between about 90 degrees C. and about 1200 degrees C. with the hot char according to the reactions $$C+CO_2 \rightarrow 2CO$$

$$C+H_2O \rightarrow CO+H_2.$$

thus producing hot fuel gas and converting energy contained in the temperature of the hot gas and char materials into usable fuel gases, including $H_2$, CO, and $CH_4$, at temperatures greater than about 700 degrees C. Below 700 degrees C., the reaction rates are much slower, and the hot gas primarily preheats incoming fuel. As wood and other biomass fuels are heated, they are first dried and then decomposed by pyrolysis into three classes of components: condensibles, char, and gas. Because no oxygen is available at the point where tar is produced, virtually all tars released during pyrolysis pass out of the updraft gasifier with the gas. Typical tar contents in updraft are about 30 percent (300,000 ppm). Such gas is burned directly and is not suitable for engine operation.

While up to a million vehicles were operated on gas fuel that was produced from wood during WW II, these gasifier engine systems provided inadequate tar cleanup. Tar accumulation within the vehicle engines and tar disposal remained a significant obstacle to commercialization. Existing updraft gasifiers that are fueled by dry wood or other dry, unpyrolyzed biomass fuels produce output gas containing typically 30% (300,000 ppm) tars. Downdraft gasifiers with nozzle air introduction, such as those of the Imbert or Hesselman type, and downdraft gasifiers utilizing stratified bed flaming pyrolysis, without nozzles, produce output gas having relatively lower but still substantial tar contents, generally in the range of 1000 ppm to 3000 ppm. Further, the use of a plurality of nozzles, orifices, and/or tuyeres, such as are found in an Imbert gasifier, undesirably causes a plurality of alternating and localized hot spots and cool spots to be formed respectively at the locations of the nozzles and at locations between the nozzles. These hot spots operate to destroy tars, but they undesirably also worsen the tendency of ash slag and clinkers to form. Undesirably, tars pass through the cool spots, and no destruction of hot tar destruction occurs in these cool spots. As a result, the tar levels in these prior gasifiers are typically between 1000 ppm and 3000 ppm.

BRIEF DESCRIPTION OF THE DRAWINGS

These and other features, aspects, and advantages of the present invention will become better understood with reference to the following description, appended claims, and accompanying drawings, where:

DESCRIPTION OF THE PREFERRED EMBODIMENTS

Figure 1:
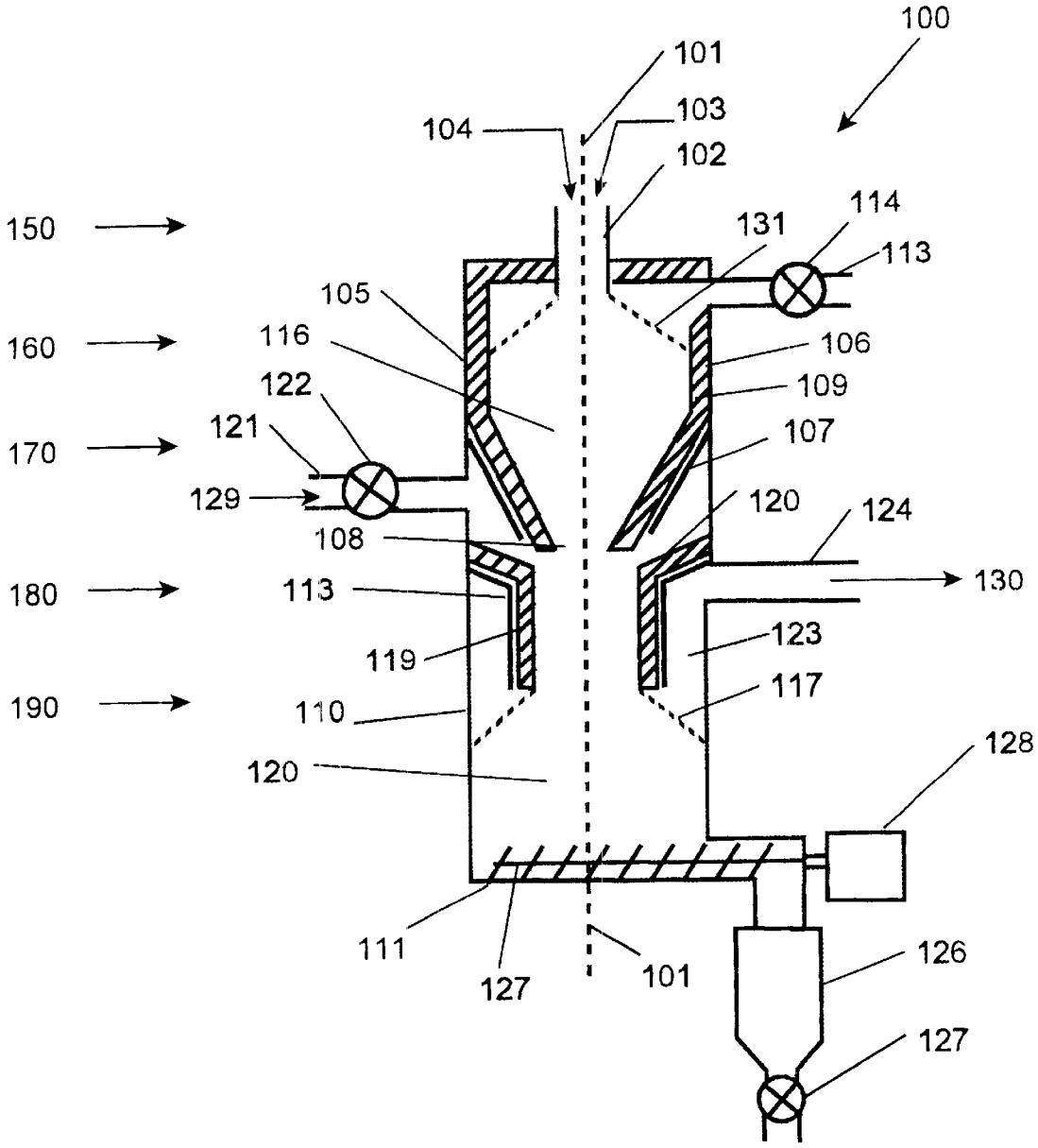
FIG. 1 is a vertical section view of a gasifier in accordance with the present invention.

The present invention provides a new apparatus and method for downdraft, thermal gasification by processing solid and particulate fuel materials to produce a gaseous fuel from solid fuels while concurrently destroying tars. The invention operates in a manner that enhances tar destruction while forming output fuel gas products $H_2$ and CO in the endothermic reactions:

$$\text{Heat}+C+CO_2 \rightarrow 2CO \quad (1)$$

$$\text{Heat}+C+H_2O \rightarrow H_2+CO. \quad (2)$$

The combustible output gas flow thus formed has a low tar content which is more easily created to be suitable for simplified and cleaner use as fuel in an internal combustion engine.

In addition to the carbon monoxide and hydrogen formed via reactions (1) and (2), some methane may also be formed, either by cracking of the tar formed during incomplete pyrolysis, or by the following reaction:

$$CO+3H_2 \rightarrow CH_4+H_2O. \quad (3)$$

This reaction is exothermic, but occurs slowly at temperatures less than about 900 degrees C. without a catalyst. However, ash can catalyze the reaction to produce clean methane.

In addition to providing fuel gases, this invention provides an improved method for production of activated carbon using single-step pyrolysis/activation to produce high grade activated carbon from low density, low value, agricultural wastes and other materials.

As used herein, the terms "gasifier" and "gasification" refer to an apparatus and a method, respectively, that operate to convert solid particulate fuel into a gaseous fuel via the action of heat and air on the solid fuel. Although prior art gasifiers produce gas having relatively higher tar contents, the present invention avoids this problem by destroying tars within the gasifier structure as the output gas is produced. As a result, the gasifier of this invention produces output gas having an extremely low tar content, generally less than about 100 parts per million, from solid, unpyrolyzed particulate fuels having a high potential for volatile organic compounds that are precursors to tar formation. In addition to substantially reducing the production of troublesome tars, the present invention also reduces problems resulting from ash fusion, slagging, and clinker formation that are characteristic of the pyrolysis of many agricultural wastes.

In accordance with the present invention, the biomass fuel may comprise any solid organic material derived from living organisms. Preferred biomass fuel materials include plant-derived materials such as wood chips and agricultural wastes. Other organic materials could be used, such as animal wastes, bacterial sludge, or fungal material, or sewer sludge. However, these materials generally have higher water content than the plant-derived materials, and they probably require drying prior to loading into the gasifier. It should be noted that excess heat from the gasifier or the engine operating with the fuel gas could be used to dry the input material. Preferably, the material entering the gasifier has a water content less than about ten percent by weight.

In the following description, any oxidizing gas could be used that reacts with the fuel under reasonable operating conditions. Air is a preferred oxidizing gas due to its ready availability, and the following discussion will refer to air. However, the gasification system of the present invention could be utilized with other oxidizing gases, particularly gases having a higher oxygen content, or even substantially pure oxygen.

As used herein, the term tar refers to all liquid that condenses from the gas stream at temperatures above about 100 degrees C.

As used herein, the term superficial velocity describes the throughput of the gasifier, expressed as the volume of the air or gas divided by the cross sectional area of the flow path, neglecting the volume of solids. In the study of air reactions with solid fuels at the higher superficial velocities, the gas may be combustion gas with no heating value. Thus, superficial velocity is more useful as a control parameter than heat flux, such as BTU/hour/cm$^2$, because it permits unambiguous expression of throughput in terms of inputs.

As used herein, the term "flame front" is defined as the level at which the transition between non-burning or unpyrolyzed biomass and burning flaming pyrolysis reaches 500 degrees C.

The downdraft system of the present invention provides stratified bed flaming pyrolysis as combustion air and fuel enter the up stream end of the gasifier, thereby avoiding localized hot spots within the gasifier. Additional air is introduced into the fuel bed downstream of the flame front. Further downstream, addition air is introduced into the char bed in a substantially continuous laminar flow. Unlike prior art gasifiers using a plurality of individual nozzles, the present invention avoids alternating hot and cold spots within the bed. Further, introducing slot-like laminar air flow into the char be permits higher gasification rates while avoiding the localized hot spots that would cause slagging and provides higher average tar destruction temperatures than does the use of nozzles. The quantity of tar-destroying air that can be used in accordance with the present invention is limited by he balance between the rate of char production and the rate of depletion of the char bed needed to maintain the position of the flame front within the gasifier and by ash slagging temperature limits.

One embodiment of the present invention is a process for gasifying particulate biomass fuel to produce low-tar fuel gases, such as those that are suitable for use in an internal combustion engine. In the process, particulate fuel is introduced into the upstream end of a gasifier in a manner that maintains a desired level of unburned fuel above the flame front. The flame front is the level where the temperature rises abruptly to combustion temperature in a partly pyrolyzed bed of particulate fuel. This partly burned bed will hereafter be referred to as the char bed.

In a first stage of tar destruction, air is provided to the flame front, or pyrolysis, zone, with the air distributed in a geometry that allows continuous production of an adequate supply of char. Although a batch-type process is within the scope of the present invention, it is preferable to operate in a continuous process, in which continuous production of char allows continuous enhanced destruction of tar. Preferably, the air flow rate is such that the peak temperature just downstream of the flame front or pyrolysis zone is between about 700 degrees C. and about 1000 degrees C. The position of the flame front, or pyrolysis zone, is at the upstream surface of the char bed. In this regard, it is desirable to control the position of the flame front.

In a second stage of tar destruction, additional tar destroying air is introduced downstream of the flame front or pyrolysis zone. Preferably, the air is introduced in a substantially uninterrupted and continuous laminar manner, with the flow direction oriented generally perpendicular to the stream flow direction in the gasifier. Extreme pulsations in the tar destroying air flow should be avoided, but moderate variations may be tolerated. The tar destroying air is introduced into the char bed at a desired depth within the char bed and at a location that is downstream from the flame front, thereby permitting the use of a broader range of particulate fuels such as low grade agricultural residues which have a high ash content, as well as fuels with a low ash fusion temperature. Preferably, the tar destroying air is introduced into the gasifier in a manner allows the air to reach the central axis of the gasifier.

It is desirable to maintain a given spatial separation between the upper pyrolysis flame front and the second stage tar destruction zone. In this regard, the pyrolysis zone operating conditions may be controlled. For example the quantity of the tar destroying air is controlled to optimize tar destruction as well as the position of the flame front and supply of char.

As a result of the second stage of tar destruction, a fuel gas is provided that can be more easily cleaned and then burned in a conventional internal combustion engine or furnace to provide heat and/or electricity. The engine may be a conventional spark-ignited gasoline engine. In addition, high quality activated charcoal may be produced. Downstream of the second stage char bed, the remaining solids, such as ash and slag, may be removed from the output gas stream, preferably in a continuous fashion.

Referring to FIG. 1, one embodiment of the present invention is a gasifier 100, which is generally symmetrical about vertical axis 101. Gasifier 100 may be constructed of a metal such as mild steel having an interior refractory lining or other suitable high-temperature material where high temperatures occur. A biomass input feed tube 102 supplies particulate material 103, such as wood chips or pellets, and air 104 to the upper portion 105 of gasifier 100. Upper portion 105 of upper section 106 comprises a hollow cylinder that is integral with a lower cone-shaped section 107. Cone-shaped section 107 terminates at an opening 108. Upper portion 105 has a refractory lining 109. Portion 105, a cylindrical wall 110, and bottom plate 111 cooperate to form a generally sealed annular chamber. The lower end of cone 107 contains a bed 112 of charred fuel or the like that has been pyrolyzed. Char is produced frown incoming fuel as it passes through the flame front. An air inlet tube 113, located near the top of upper portion 105, is equipped with a valve 114 for controlling air inflow into the interior of upper portion 105.

The char bed 116, located generally in the central portion of the gasifier's flow path, is the zone of further tar destruction. The middle portion 117 of gasifier 100 has a conical upper section 118 and an integral cylindrical lower section 119. Middle portion 117 also has a refractory lining 120. Tar destroying air inlet 121 is equipped with a valve 122 to control air inflow into middle portion 117. Annular space 123, between cylindrical wall 110 and middle portion 117, provides for gas flow from the gasifer to gas outlet 124.

A rotating auger 125 within an at the bottom of cylindrical housing 110 carries the ash away for appropriate disposal via char outlet housing 126 and char/solids outlet valve 127. Auger 125 is driven by motor 128. The fully pyrolyzed material accumulates below the tar destruction zone, with an angle of repose 135. Gas disengages from the solid char, ash, and dust in space 123.

When gasifier 100 is used, fuel particles 103 introduced into portion 105 of the gasifier via feed tube 102 accumulate with a top surface 131 defined by the angle of repose of the fuel material 103. The mixture of solid biomass fuel and air is initially ignited by a suitable ignition system known in the art. Preferably, the flame front is maintained within upper cylindrical section 106 to obtain controlled pyrolysis of the solid fuel. If insufficient air enters the system through input tube 102, it may be necessary to introduce additional air through air control valve 114 and air input tube 113 to maintain the and front within cylindrical section 106. Tar destroying air 129 enters the char bed 116 via an input pipe 121 and control valve 122. This tar destroying air 129 flows in a continuous, 360 degree, slit-like laminar air flow pattern into the char bed 116. The output product gas 130 exits gasifier 100 via annular space 123, where solids drop out of the gas stream. Solids, comprising as and slag, are removed by auger 125.

The dimensions of the van us components of gasifier 100 may be selected to optimize processing of the particular solid biomass fuel utilized. In accordance with the present invention, it has been recognized that the position of the flame front along the flow path in the gasifier is particularly important. The flame front should be maintained within cylindrical upper section 106. If the flame front moves upstream into the feed tube 102, uncontrolled ignition of the solid fuel supply may result. If the flame front moves downstream into conical section 107, it may rapidly advance further downstream into middle portion 117, eliminating the benefit of the two-stage tar destruction process of the present invention. The rate at which gas is supplied to the upper section 106 can affect the position of the flame front. Thus, feed tube 102 is preferably of relatively small diameter to help maintain the flame front position within upper section 106. All pyrolysis air enters air input tube 113 and valve 114. One or more temperature sensors may be placed within the char bed to determine the position of the flame front, and this temperature information may be used to control he input air flow rate through valves 114 and 122 and the operation of auger 125 for solids removal.

For the best tar destruction, the flow rate of the tar destroying air 129 entering the system via input pipe 121 and control valve 122 is between about 25 percent and about 75 percent of the total amount of air entering the system. Also, preferably, the flow rate of the tar destroying air 129 is between about 25 percent and about 75 percent of the flow rate of the output gas 130 out of gasifier 100. Measurements of the gas outflow may be used to control the rate of air inflow using control valve 122.

Sections 107 and 118 are to allow a larger area for the flame front in upper section 106. This larger area for e flame front allows greater production of char in upper portion 105. The taper angle of conical section 107 is relatively steep for easier material flow and to prevent bridging of the solid material. The taper angles of conical sections 107 and 118 may be provided to adapt the pyrolysis are a required for adequate char production with the smaller diameter needed to achieve the high temperatures required for good tar destruction in the middle portion 117.

For many applications, it is desirable that the gasifier of the present invention operates with a slightly lower internal pressure than ambient air pressure to prevent escape of toxic products, such as carbon monoxide. However, it may be beneficial to operate the gasifer at a greater pressure than ambient air pressure to allow higher throughput, such as if the gasifier is operated with pure oxygen instead of air to make methanol and/or synthetic crude oil. In this event, safety equipment known in the art should be used to prevent gas leakage out of the system and to verify that the workplace is safe. It should be noted that increased oxygen concentrations relative to air may result in increased temperature and any solid char fuel.

In one gasifier in accordance with the embodiment of FIG. 1, designed for pyrolysis of wood chips, feed tube 102 is about 3 inches in diameter, hollow cylinder 106 is about 1 foot 7 inches in diameter and about 6.25 inches in vertical height; lower cone-shaped portion 107 is about 1 foot 4.25 inches in vertical height, opening 108 has a diameter of about 7 inches. Cylinder housing 119 may has an inner diameter of about 7 inches and a vertical height of about 10 and ½ inches. Cylindrical housing 110 has a diameter of about 14 inches and a vertical height of about 1 foot 2 inches.

Figure 2:
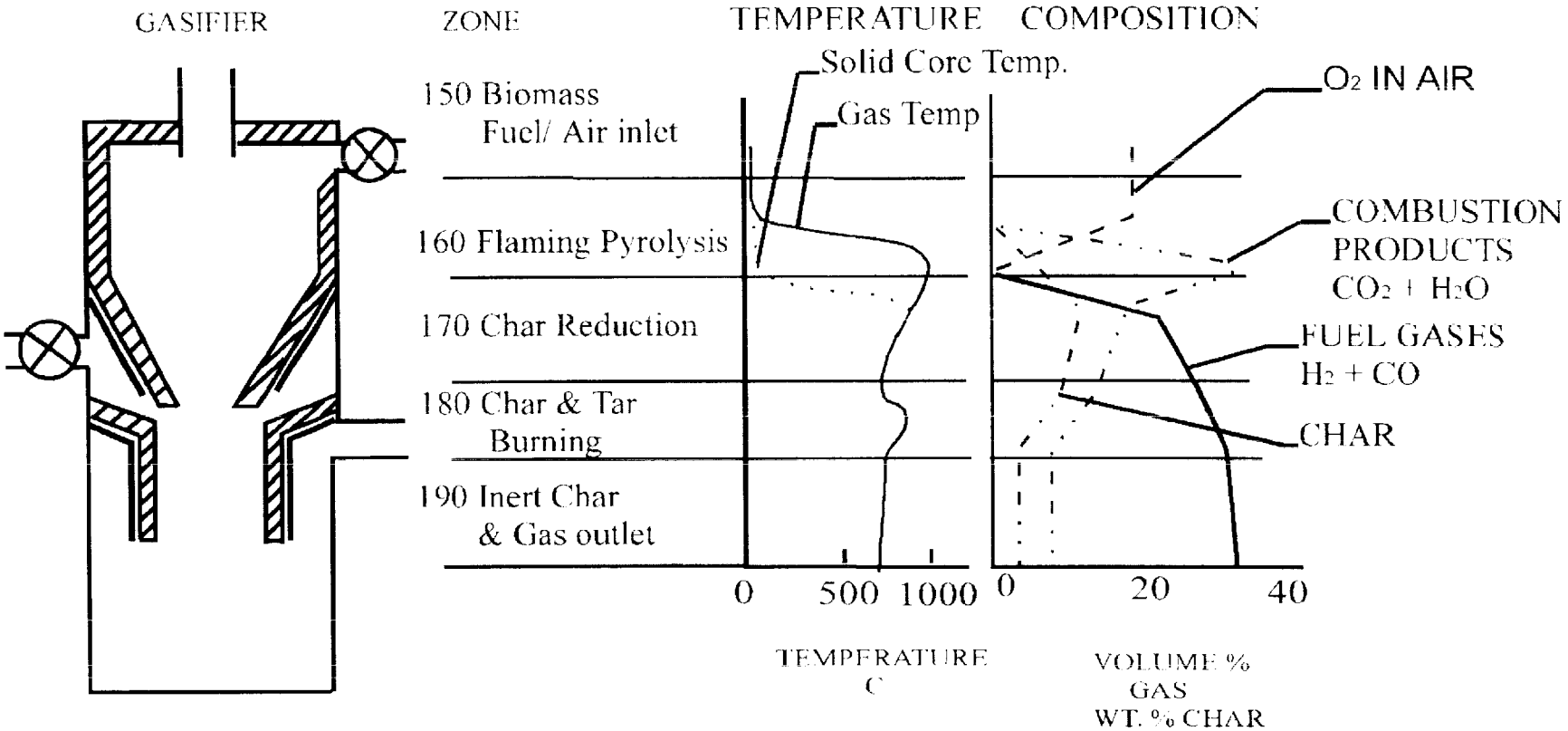
FIG. 2 shows the temperatures and the gas compositions in the various vertical zones that exist within the gasifier of FIG. 1.

FIG. 2 shows the temperatures and the gas compositions that exist within the various vertical zones of gasifier 100. These zones correspond to the zones identified by the numbers 150, 160, 170, 180, and 190 in FIG. 1.

The upper zone 150 within gasifier 100 comprises the zone in which solid particulate fuel and air are admitted by way of fuel inlet 102. As can be seen, the temperature is low in this zone, and the gas composition comprises the input air.

The next lower zone 160 is the flaming pyrolysis zone, where air enters the top of the fuel bed and encounters the flame front at surface 131. In zone 160, the gas temperature increases as oxygen is consumed, and char, $H_2O$, and $CO_2$ are produced by the pyrolysis of the fuel. The temperature of the cores of the biomass fuel particles is lower than the gas temperature but increases as pyrolysis reaches completion.

The next lower zone 170 is generally within the char bed. In this zone, the $H_2O$ and $CO_2$ content decrease as the char is reduced, and output fuel gas products $H_2$ and CO are formed in the endothermic reactions (1) and (2).

The injection of tar destroying air, as at 121 of FIG. 1, occurs generally between zone 170 and the next lower zone 180. Zone 180 is the tar burning zone of gasifier 100. In zone 180, the output gas products CO and $H_2$ continue to form while the $H_2O$ and $CO_2$ contents continue to decrease.

The lowest zone 190 generally corresponds to annular volume 123 within gasifier 100 in FIG. 1. Zone 190 contains essential y only inert char and output gas 130. Inert char is char in which most of the carbon has already been combusted or that is too small for good gas permeability or that is outside of the gas stream and cooled below 700 degrees C.

Figure 3:
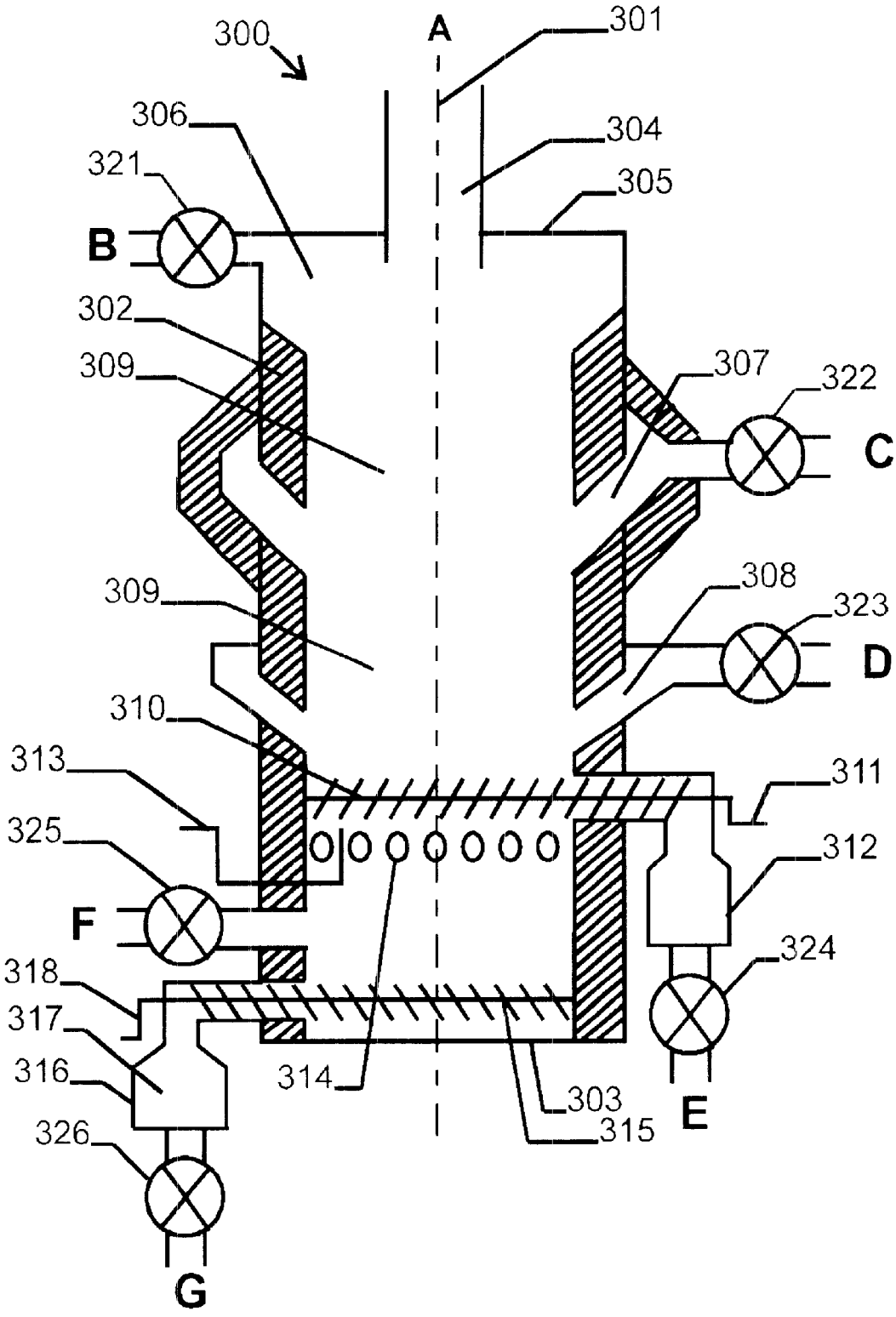
FIG. 3 is a vertical section view of a multi-mode gasifier in accordance with the present invention.

The gasifier embodiment shown of FIG. 1 operates in a single mode to produce low-tar output gases. However, as can be understood with reference to FIG. 3, a multi-mode gasifier 300 can also be constructed in accordance with the present invention for use under variable operating conditions to produce varying proportions of different products. Gasifier 300 is generally symmetrical about vertical axis 301 and is constructed of a metal such as mild steel and has a refractory or other heat resistant interior lining 302 in the zones where high temperatures occur. Gasifier 300 has a bottom panel 303 that closes the bottom of gasifier 300. As shown in FIG. 3, fuel 304 fills gasifier 300. Inlet/outlet pipe A, corresponds generally to inlet pipe 102 in FIG. 1 and accommodates fuel, as well as air and/or gas in some operating modes. First inlet/outlet B communicates with a 360-degree annular volume 306 that is formed in the top portion of gasifier 300 and corresponds generally to inlet 113 in FIG. 1. Second inlet/outlet C communicates with a 360-degree annular volume 307 formed in the top portion of gasifier 300 below volume 306. Third inlet/outlet D communicates with a third annular volume 308 that is formed generally in the middle portion of gasifier 300, below volume 307. Volume 308 corresponds generally to volume 123 in FIG. 1. In some modes of operation, char-ash, charcoal, and/or activated carbon 309 accumulate above auger/collector 310. Indeed, it is desirable to produce carbon as a byproduct of the gasification process, because the carbon helps to prevent ash from melting to form slag, which is corrosive to the refractory lining and the steel walls of the gasifier. A motive means 311 is provided to auger-transport char-ash, charcoal or activated carbon 309 to a collector 312. Motive means 311 may be a manually operable or automatic handle. Actuator 313 is adapted to cause oscillating grate 314 to oscillate horizontally for some modes of operation. An additional auger 315 and collector 316 are provided for removing ash and slag 317 from the bottom of gasifier 300. A motive means, such as a manually operable handle or motor 318, is also provided to auger-transport ash and slag 317 to a sump area in collector 312. Closeable inlets/outlets B, C, D, E, F, and G include valve members 321, 322, 323, 324, 325, and 326, respectively. Note that in all of the modes of operation actuator 313 and auger 315 of FIG. 3 are operable, as needed and intermittently.

Forge fuel mode can be used for direct combustion applications. In forge fuel mode, inlet pipe A is open to allow air to enter the gasifier. Tar-laden gas exits via first inlet/outlet B. Second inlet/outlet C is closed. Third inlet/outlet D may be either closed or open to allow air into the gasifier. Auger/collector 310, motive means 311, and collector 312 are not utilized. Actuator 313 is operational, causing oscillating grate 314 to oscillate. Auger 315 and collector 316 and motive means 318 are operated to transport ash 317 to collector 316. Air inlet F and valve 325 allow a controlled quantity of air to enter volume 327.

Tar burning mode, similar to the process described by DeLaCotte, *Handbook of Biomass Downdraft Gasifier Engine Systems*, Thomas B. Reed and Agua Das, U.S. Government Printing Office, SERI/271-3022, March 1988, P. 44) can be used for providing a gaseous fuel for engines. In tar burning mode, inlet A provides air to the gasifier. Tar-laden gas exits via first inlet/outlet B, passes to a tar burner (not shown), and is returned to gasifier 300 through second inlet/outlet C. Low tar gas exits via third outlet D. Charcoal is removed from the gasifier apparatus 300 by auger/collector 310 and motive means 311 to collector 312. Actuator 313 is operational, causing oscillation of grate 314. Auger 315, collector 316, and motive means 318 are operated to transport ash 317 to collector 316. Air inlet F and valve 325 are closed.

India tar burning mode, similar to the process described by Mukunda in *Energy for Sustainable Development*, Vol. 1, No. 3, September 1994, pp. 27–38, can also be used to provide a gaseous fuel for engines. In India tar burning mode, inlet pipe A provides fuel and air to the gasifier. Additional air is added to the system in this mode via first inlet B and via one or more nozzles at second inlet C, without air flow control. Low tar gas exits via third outlet D. Charcoal is removed from the gasifier apparatus 300 by auger/collector 310, motive means 311, and collector 312. Actuator 313 is operational, causing oscillation of grate 314. Auger 315, collector 316, and motive means 318 are operated to transport ash 317 to collector 316. Air inlet F and valve 325 are closed.

Enhanced tar burning mode is preferred for providing a gaseous fuel to engines. In tar burning mode, inlet pipe A provides fuel and air to the gasifier. Air is also added in a controlled manner to the system via first inlet B and second inlet C. Low tar gas exits via third outlet D. Charcoal is removed from the gasifier apparatus 300 by auger/collector 310, motive means 311, and collector 312. Actuator 313 is operational, causing oscillation of grate 314. Auger 315, collector 316, and motive means 318 are operated to transport ash 317 to collector 316. Air inlet F and valve 325 are closed.

The apparatus 300 of the present invention may also be used to produce activated carbon. In activated carbon mode, inlet pine A provides fuel and air to the gasifier. More air is added via in a controlled manner to the system via first inlet B, second inlet C, and third inlet D. Charcoal 309 is removed from the gasifier apparatus 300 by auger/collector 310, motive means 311, and collector 312. Actuator 313 is operational, causing oscillation of grate 314. Auger 315, collector 316, and motive means 318 are operated to transport ash 317 to collector 316. Low tar gas leaves the gasifier 300 via outlet F and valve 325.

The apparatus 300 of the present invention may also be used in updraft mode for direct combustion applications where high tar content is not of concern and the output fuel gas is not intended for use as an engine fuel. In updraft mode, inlet pipe A is used to introduce fuel into apparatus 300 but is sealed to prevent air from entering. A controlled air stream enters the gasifier via inlet F and, optionally, via air inlets C and D. Optionally, char may be removed from the gasifier apparatus 300 at port E by auger 310, collector 312, and motive means 311. Actuator 313 causes grate 314 to oscillate, auger 315 and collector 316 and motive means 318 are operated to transport ash 317, which may be white ash, to collector 316. Rice hull ash is a valuable source of low iron silica for high quality refractories and premium low iron glass.

Figure 4:
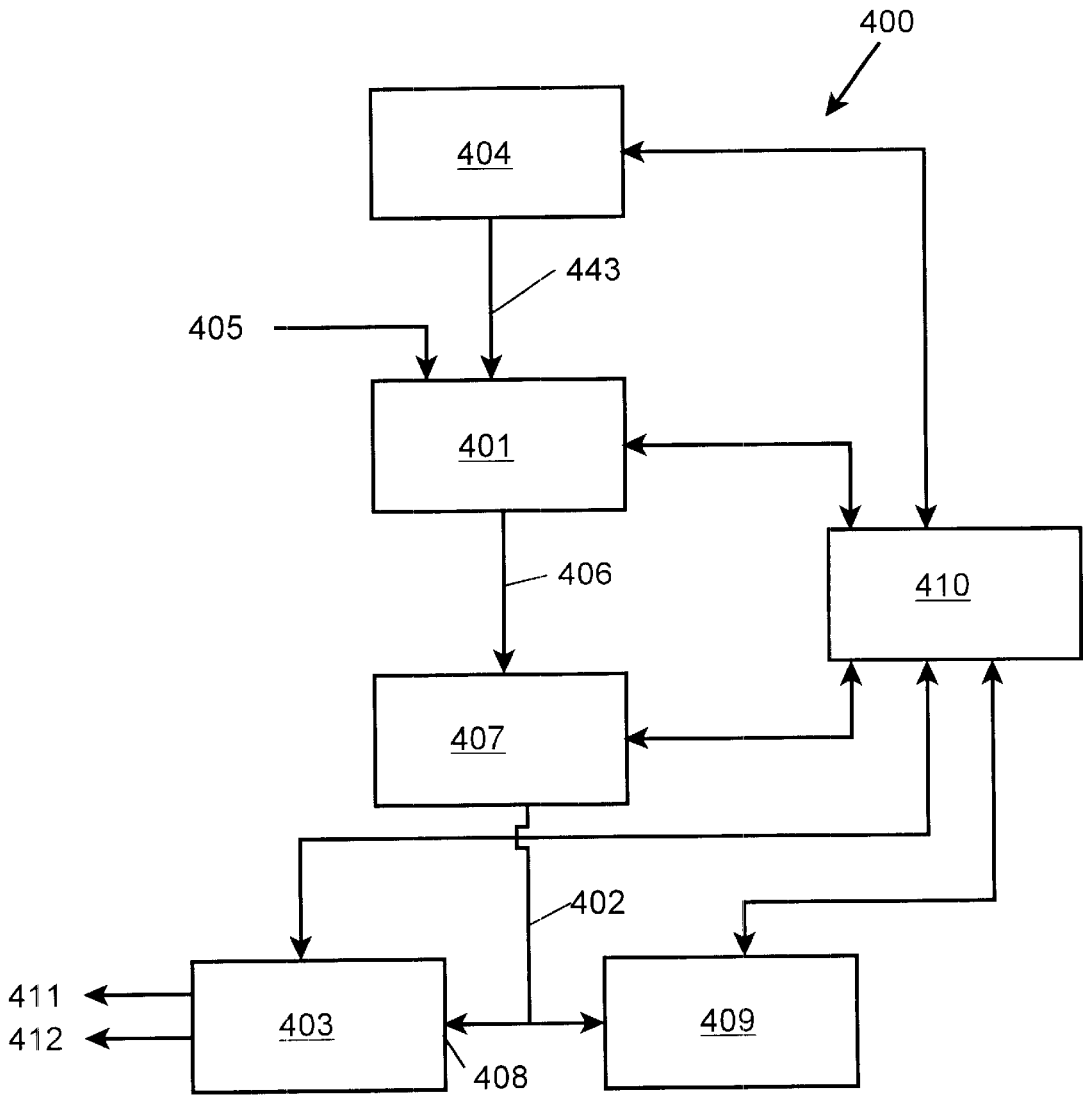
FIG. 4 is a flow chart showing details of a solid fuel gasification system in accordance with the present invention.
Figure 5:
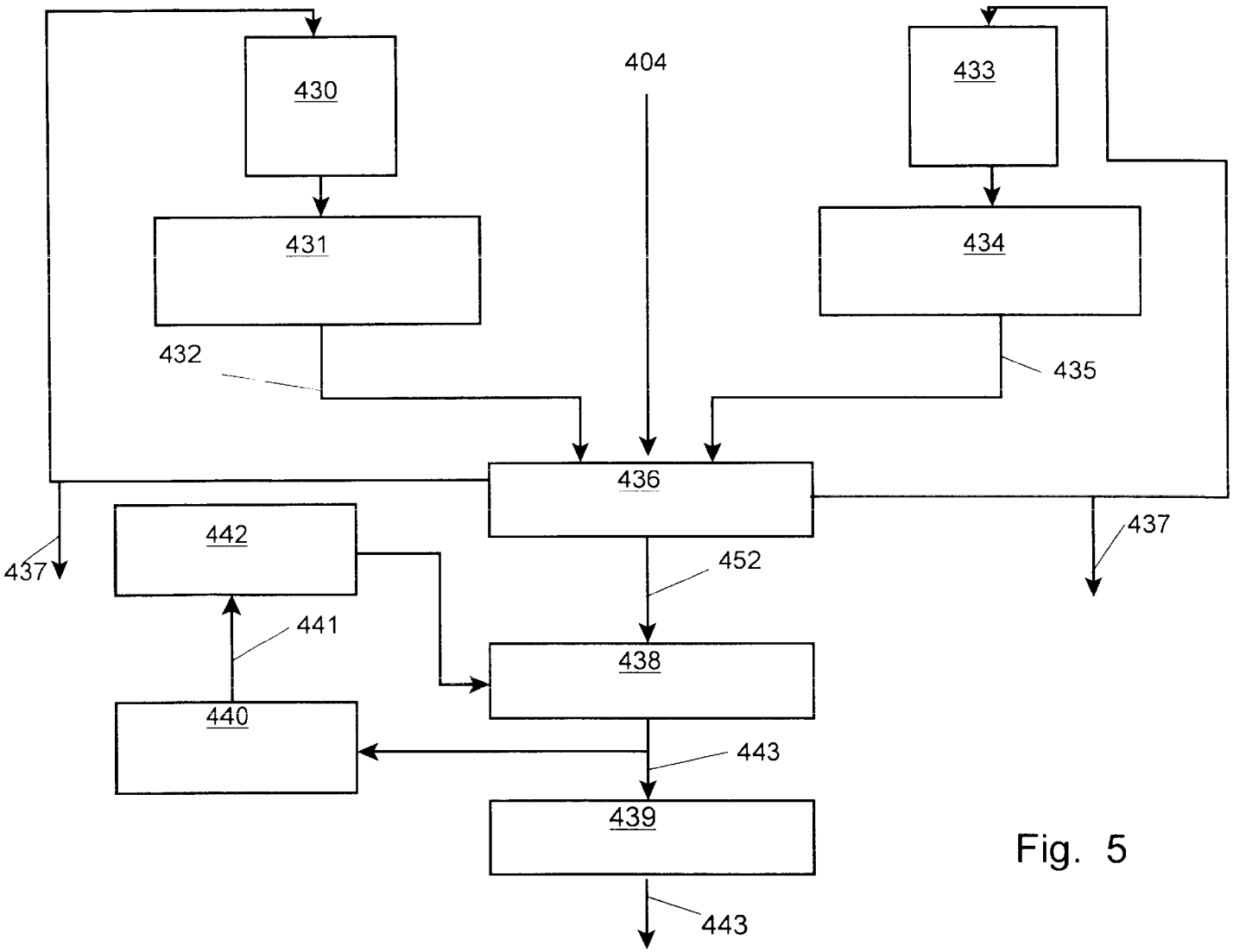
FIG. 5 is a flow chart showing details of the fuel supply portion of the gasification system of FIG. 4

FIG. 4 shows the essential elements of a system 400 by which a gasifier 401 supplies gaseous fuel 402 to an internal combustion engine 403. As above described, a solid particulate fuel supply 404, such as a supply of wood chips, is provided as an input to gasifier 401, along with a supply of combustion-supporting input air 405. The gaseous output 406 of gasifier 401 comprises combustible components, including hydrocarbons, for example the $H_2$ and CO output in zone 190 of FIG. 2. This gaseous output 406 is then cooled and cleaned of solid and/or particulate matter to below 10 ppm total in unit 407. The resulting cooled and cleaned combustible gas 402 is then drawn into the fuel-input 408 of internal combustion engine 403, and any excess gas is safely consumed at a gas flare unit 409. A control system 410 receives input signals from and provides output signals to the fuel supply 404, the gasifier 401, the cooling/cleaning unit 407, the engine 403, and the flare unit 409. Engine 403 outputs heat 411 and/or electricity 412.

FIGS. 5–9 show details of the system 400. The fuel supply portion 404 of system 400 can be understood with reference to FIG. 5. A fuel sifter unit 436 operates upon solid fuel raw inputs 404, 432 and 435 to separate both oversize and undersize pellets/pieces. The separated oversize pieces may be sent to a size reducer 433 or discarded at 437, and undersize pellets and pieces may be sent to pelletizer 431 for further use, or discarded. A supply of solid particulate fuel, such as wood chips, having a particle size to small for efficient use in gasifier 401, is provided at 430. An optional pelletizer 431 operates to gather given quantities of small-sized supply 430 into a unit quantity and then pelletizes or densifies this unit quantity into individual solid fuel pellets, cubes, chunks, etc. 432. A supply of solid articulate having a particle size too large for proper use in gasifier 401 is provided at 433. An optional size-reducing unit 434 operates on large-size fuel supply 433 to provide individual solid fuel pieces 435 that are about equal in physical size to the pellets formed 432. Solid fuel pieces 452 that pass the size-inspection by fuel sifter 436 are then subjected to a drying process at drier unit 438, whereupon dry fuel pellets and/or pieces are placed in a fuel hopper unit 439 for supply to the gasifier 401.

A moisture sensor 440 is pr vided to respond to the moisture content of the flow of correctly sized pieces 452, 432, and 435. Sensor 440 provides an input signal 441 to a control system 442 that operates drier unit 438 in a manner to achieve a control-point moisture content within the flow of pellets and piece into hopper 439. By way of example, drier unit 438 may use the exhaust gas heat and/or the output heat of engine 403. An engine typically produces twice as much energy as heat than it produces as shaft power.

Figure 6:
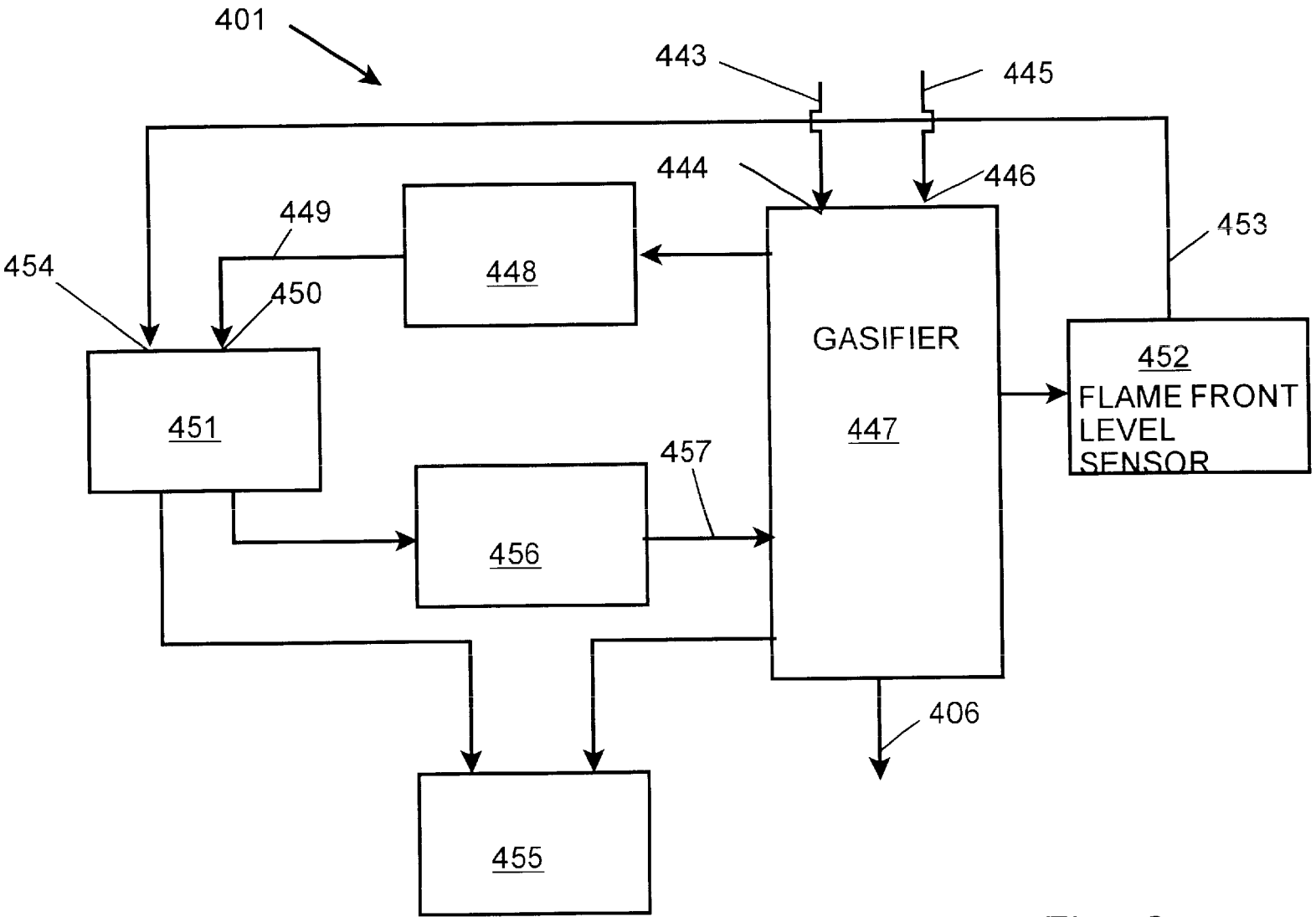
FIG. 6 is a flow chart showing further details of the gasifier control portion of the system of FIG. 4.

With reference to FIG. 6, the solid fuel output flow 443 of the solid fuel hopper 439 is provided to the combustible solid fuel input 444 of gasifier 447, and a supply of pyrolysis combustion air 445 is provided to the combustion air-input 446 of gasifier 447. The construction and arrangement of gasifier 447 is in accordance with the present invention. A pressure sensor 448 operates to sense the spressure pressure drop across the gasifier 447 and to provide an associated input signal 449 to a first input 450 of an air/ash control system 451, whereas a vertical flame front height sensor 452 senses the vertical position of the flame front within gasifier 447 and provides an associated input signal 453 to the second input 454 of control system 451.

As a result of control system 451 responding to control signals 450 and 454, tar-destroying air control 456 and char-ash removal and storage unit 455 are operated. The air flow 457 of air control valve 456 supplies tar-destroying air to the laminar air flow input 121 and control valve 122 of FIG. 1, as is shown by the air injection at zone 180 of FIG. 2, or, similarly, air flow 457 from controller 456 controls tar-destroying air to volume 307 of FIG. 3. The operation of char-ash removal an storage unit 455 corresponds to the operation of auger 125 in FIG. 1, or to the operation of auger 310 of FIG. 3 in enhanced tar burning mode.

Figure 7:
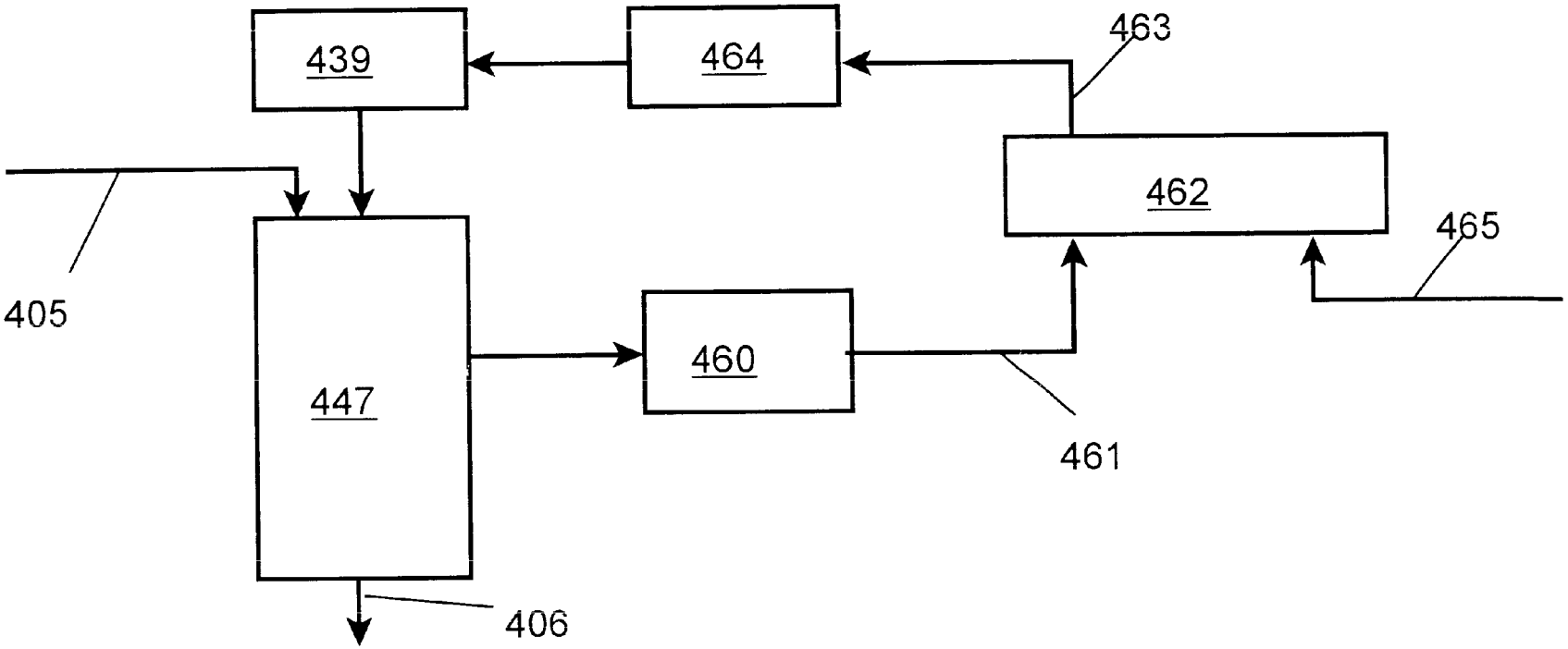
FIG. 7 is a flow chart showing further details of the fuel level control portion of the system of FIG. 4.

The fuel level control portion of system 400 can be understood with reference to FIG. 7. Fuel hopper 439 of FIG. 5 and gasifier 447 of FIG. 6 are again shown. A fuel level sensor 460 senses the vertical height or level of the solid fuel bed 304 (FIG. 3) that is within gasifier 447. Sensor 460 provides a first control signal 461 that is indicative of this vertical fuel bed level to a first input of fuel level control system 462. As a result, the output 463 of fuel level control system 462 controls a fuel feed actuator 464 in order to maintain a vertical fuel bed height that is specified by an input reference signal 465 (or by a position sensor that responds to the fuel level within the gasifier) that is provide as a second input to control system 462.

Figure 8:
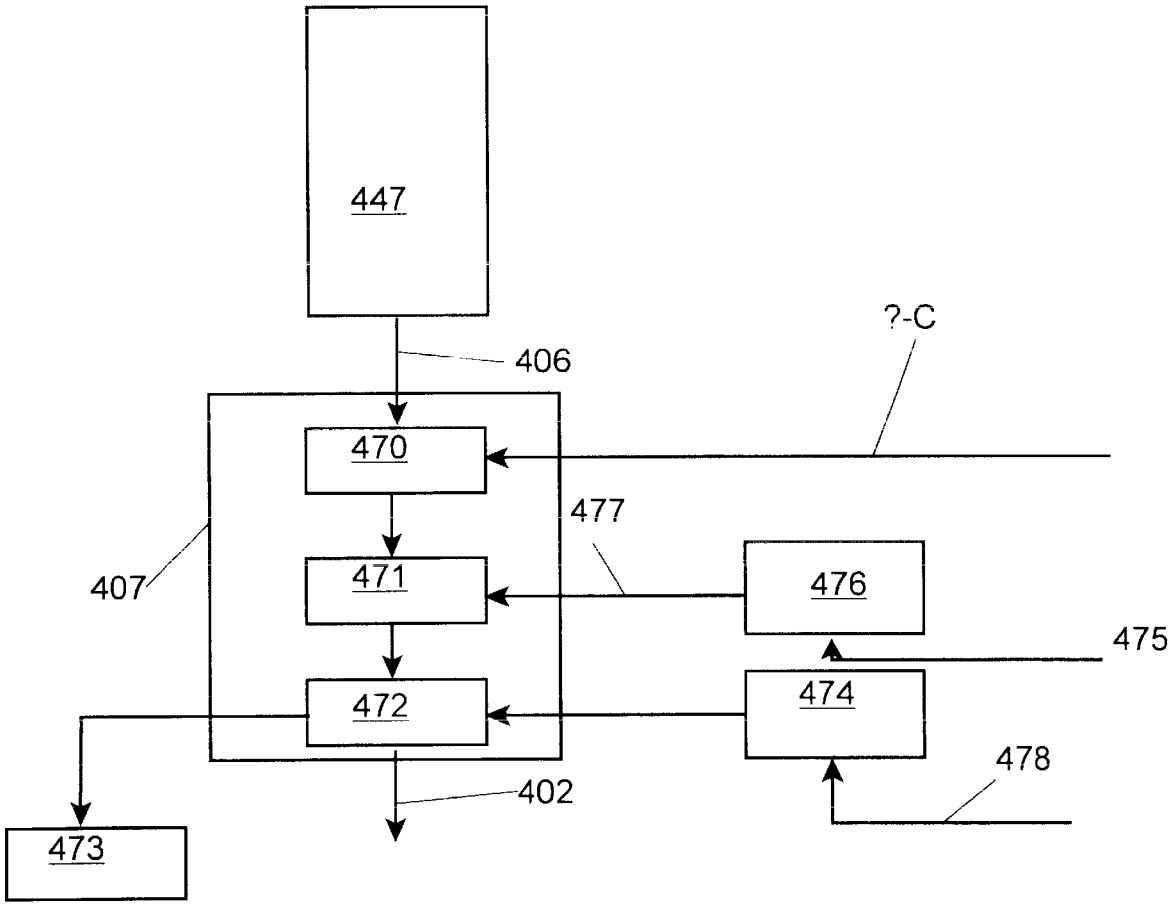
FIG. 8 is a flow chart showing further details of the output gas cooling and cleaning portion of the system of FIG. 4.

The output gas cooling/cleaning portion 407 of system 400 can be understood with reference to FIG. 8. A controlled output gas cooling feature of the invention prevents water condensation and liquid discharges from occurring in the gasifier's output gas. The gaseous output 406 of gasifier 447 first passes through a first controllable gas flow valve 470, then into the gas-cooler portion 471 of FIG. 4's gas cooling/cleaning unit 407, and then into the gas-filter or cleaning portion 472 of FIG. 4's gas cooling/cleaning unit 407, wherein gas filter portion is provided with a solids storage unit 473. A gas temperature sensor 474 operates to sense the temperature of the gas within gas filter portion 472. A corresponding signal 475 that is indicative of this gas temperature is provided as a first input to a gas cooler control system 476. The output 477 of control system 476 controls the operation of gas cooler 471 in a manner to maintain a set-point gas temperature that is specified to control system 476 by a second input temperature-reference signal 478.

The output gas is cooled by contact with one or more heat exchange surfaces, such as the uninsulated exterior of the gasifier pipe surface and other surfaces in contact with the gas. The cooling rate is preferably in the range of 0.25 to 1.0 $m^2$/kw (square meters of gas cooling heat exchange surface per kilowatt of peak generator capacity). Optionally, additional trim features, such as adjustable insulation and controlled blowers may be added to obtain finer control of the gas temperature, such as may be needed for severe service such as rapidly varying loads or operation of a gasifier at a small fraction of its capacity. Water condensation inside the gasifier system is undesirable, and condensation may be prevented by keeping all solid surfaces in contact with the gas stream above the water dew-point of the gas by at least about 30 degrees C. Preferably, the raw gas is cooled to a temperature as cool as possible without dropping below the water dew point. More preferably, the raw gas is cooled to a temperature greater than the water dew point by a safety margin adequate to prevent water condensation.

Because the present invention provides enhanced tar destruction capability, a gasifier in accordance with the present invention may include a continuously self-cleaning gas cleaning system. For example, the cooled raw gas may pass through a baghouse filter. Baghouse filters comprise a fabric or felt filter medium of moderate density, supported in a manner that it can be mechanically flexed or pulsed to dislodge some of the accumulated cake as needed to prevent excessive pressure drop and to preserve enough filter loading to maintain high filter efficiency. Gas cleaning occurs in part by the collection of particulates and condensibles on the surface of the fabric filter material. The major part of gas cleaning and the high collection efficiency of fine particles occurs by collection of particulates and condensibles on the dynamic cake layer of previously collected material on the surface of the fabric filter material.

This system in accordance with the present invention is intended/designed to operate without a cyclone or other preliminary dust removal. Although any tars in the raw gas stream are sticky, the high dust content of the raw gas acts as a dust pre-load for the filter bag surface, rendering the mixture of dust and tar substantially less sticky and more easily crumbled and dislodged from the bag surface by pulsing or mechanical flexing. Removing collected material from the gas stream in this manner makes continuous gas cleaning operations possible.

As a feature of the invention, an automatically adjusting and multi-fuel gaseous/liquid engine fuel/air mixer operates to maintain fuel/air ratio for good gasoline engine operation, and automatically adapts to any variations in the gaseous fuel heat value. Gas flow valve 470 is controlled in a manner that can be understood with reference to FIG. 9. A gas filter controller that responds to the pressure drop across gas filter 472 may be provided to control gas filter 472, as by initiating the operation of a filter cleaning unit, not shown.

Figure 9:
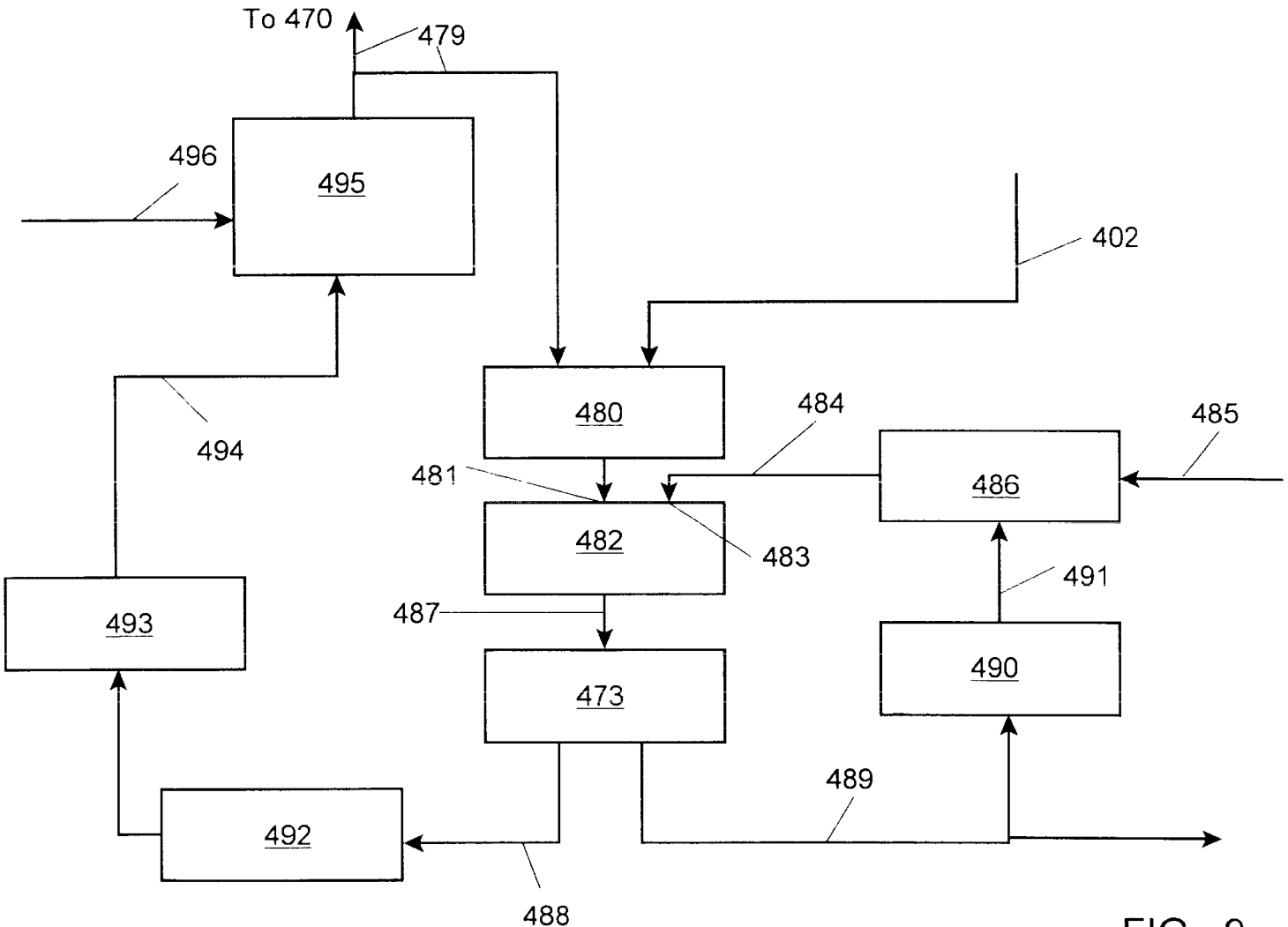
FIG. 9 is a flow chart showing details of the engine control portion of the system of FIG. 4.

With reference to FIG. 9, he gaseous output 402 of FIG. 8's gas filter 472 first passes through a second controllable gas flow valve 480, and then passes to the gas-input 481 of a gas/air reheater unit 482. A second air-input 483 of reheater unit 482 receives a variable supply of combustion air 484 from a combustion air supply 485 by way of a controllable air flow valve 486.

The combustion gas/air output 487 of reheater unit 482 is then supplied to the fuel intake of internal combustion engine 473, which corresponds to engine 403 in FIG. 4. As a result, engine 473 operates, the engines output shaft 488 rotates, and engine exhaust gases 489 are generated.

An oxygen sensor 490 operates to sense the oxygen level that is within exhaust gas 489, and the sensor's output signal 491 is connected as an input to air flow valve 486 in order to control fuel/air mixture 487 in a manner to achieve a desired quantity of oxygen within engine exhaust gas 489.

An auxiliary fuel supply (not shown) can be connected to engine 473, generally in parallel with output 487, if desired. For example, this auxiliary fuel supply an be used as the gasifier warms up or reaches its final operating conditions.

The engine's output shaft 488 is connected to a measuring-means that operates to measure the speed of operation of engine 473 that is achieved by fuel/air mixture 487. For example, an AC generator 492 is driven by output shaft 488, and a frequency sensor 493 provides an output signal 494 that is indicative of the speed of rotation of shaft 488.

A gas flow control system 495 receives shaft/engine speed signal 494 as a first input and receives an engine speed reference signal 496 as a second input signal.

In response to the two input signals 494 and 496, control system 495 generates a control signal 479 to control first gas flow valve 470 and second gas flow valve 480 in a manner to achieve a gas/air output 487 and a speed of operation on engine 473 and its output shaft 488 in accordance with the speed that is required by reference signal 496.

Figure 10:
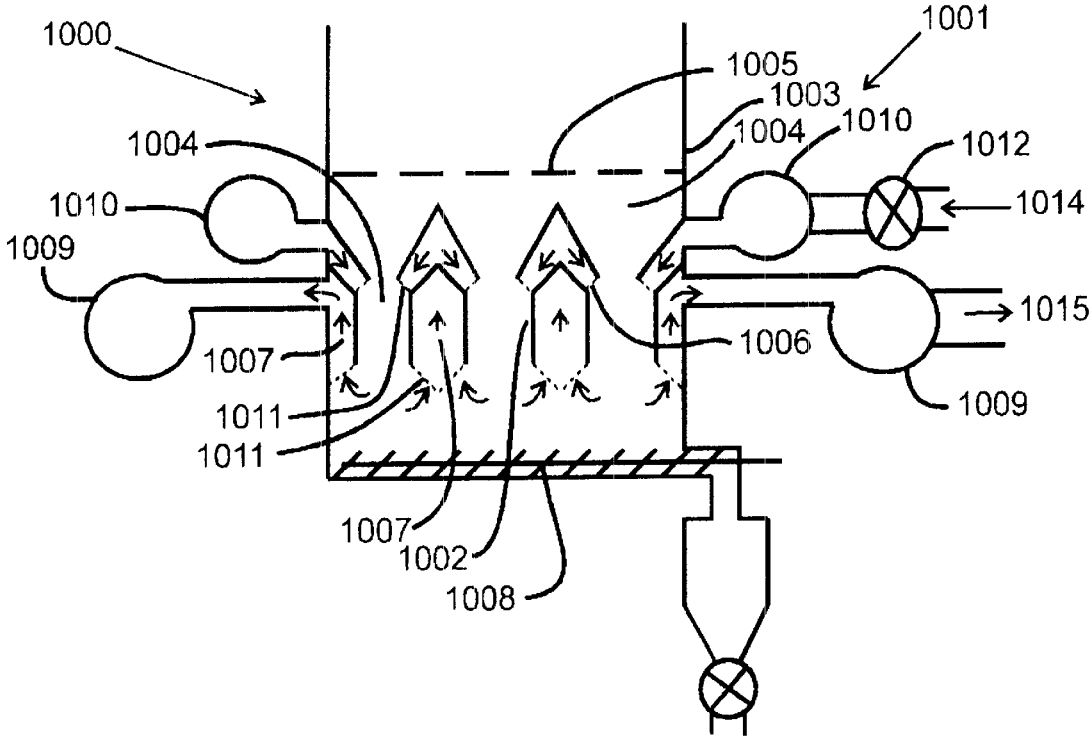
FIG. 10 is a cross sectional view of a gasifer in accordance with the present invention having an array of char support elements/gasification modules.

The distance to the peak temperature of the flame front is a characteristic of the fuel. The optimum dimensions of a gasifier pyrolysis zone in accordance with the present invention are determined by the biomass fuel type and particle size. To gasify larger quantities of biomass and obtain larger volumes of output gas and/or charcoal, a larger gasifier may be implemented with an array or a grid of relatively small gasification modules to assure the proper supply of air and gas removal to the interior of a large diameter gasifier in accordance with the invention. FIG. 10 shows an example of an array of gasification modules in which pyrolysis air and tar destruction air are introduced in geometries other than circular. A plurality of gasification modules operate in a parallel fashion in these larger gasifiers.

One embodiment of a larger-scale gasifier 1000 in accordance with the present invention may be understood with reference to FIG. 10. Gasifier 1000 includes an array 1001 of small gasification modules 1002 within outer wall 1003. Fuel/char bed 1004 has accumulated inside outer wall 1003 and around char support elements/gasification modules 1002. The flame front 1005 is within the upper portion of outer wall 1003. Air inlets 1006 are disposed in a substantially planar arrangement and receive air from air plenum 1010 to provide air for tar removal in fuel/char bed 1004 within gasification modules 1002. A plurality of gas outlets 1007 are disposed about the gasification modules 1002, also in a substantially planar arrangement, and gas outlets 1007 are in fluid communication with gas plenum 1009, also in a substantially planar arrangement. Gas outlets 1007 are positioned downstream of air inlets 1006. Auger 1008 is located farther downstream and functions to remove particulates from the gasifier.

In use, the gasifier 1000 the flow of air 1014 into air plenum 1010 is controlled by valve 1012. Air 1014 flows into gasification modules 1002. Solid fuel is added from the top of gasifier 1000. Gaseous products exit gasifier 1000 through gas outlets 1007 and gas plenum 1009. Angles of repose 1011 for solid materials are indicated with dashed lines in FIG. 10.

I claim:

1. A process for producing combustible fuel gas from solid biomass fuels, comprising the steps of:

providing a fuel comprising a particulate biomass fuel at an upstream position within a gasifier to form a fuel bed, wherein said fuel bed comprises a sequence in a downstream direction of uncombusted fuel, a pyrolysis zone including a flame front, and char;

providing an oxidizing gas to a pyrolysis zone in said fuel bed for a first stage of tar destruction and fuel gas formation, wherein said oxidizing gas is distributed in a geometry that allows continuous production of char and fuel gas from said uncombusted fuel;

passing said char in a generally downstream direction through a second stage tar destruction zone in the gasifier;

providing additional oxidizing gas to said char in the second stage tar destruction zone to destroy tar and form additional combustible fuel gas;

controlling at least one of (a) the flow rate of said oxidizing gas to maintain said flame front at a predetermined level or zone within id fuel bed, and (b) the flow rate of said additional oxidizing gas into said char bed; and outputting said combustible fuel gas.

2. The process of claim 1, wherein said step of providing said oxidizing gas in said first stage of tar destruction comprises providing said oxidizing gas in combination with said biomass fuel, providing said oxidizing gas separately from said biomass fuel, or a combination thereof.

3. The process of claim 1, wherein said step of providing an oxidizing gas in said first stage of tar destruction comprises providing said gas with a flow rate that is substantially unrestricted other than by passage through said fuel bed.

4. The process of claim 1, wherein said step of providing said second oxidizing gas further comprises providing said gas at a flow rate between about 25 percent and about 75 percent of the total flow rate of said first oxidizing gas into said pyrolysis zone and said second oxidizing gas into said second stage tar destruction zone.

5. The process of claim 1 wherein said step of providing said second oxidizing gas further comprises providing said gas at a flow rate between about 25 percent and about 75 percent of the output flow rate of said combustible fuel gas.

6. The process of claim 1, wherein at least one of said first and second oxidizing gases comprises air.

7. The process of claim 1, wherein said second stage tar destruction zone is confined within a space having dimensions selected such that said second oxidizing gas can penetrate deeply enough into said char to destroy tars remaining in the gas.

8. The process of claim 1, wherein said combustible fuel gas includes substantial quantities of combustible gas selected from hydrogen, carbon monoxide, methane, and combinations thereof.

9. A gasifier for producing a combustible fuel gas from a solid biomass fuel, said apparatus comprising:

a substantially enclosed chamber having upstream and downstream ends and a flow path therethrough for solid and gaseous materials;

a first reaction section within said chamber and adjacent the upstream end, said first reaction section including a char production zone for producing char in a char bed from a solid biomass fuel, a fuel inlet for introducing said solid biomass fuel into said char production zone, and a first inlet for introducing oxidizing gas into said first reaction section;

a second reaction section within said chamber and downstream of said first reaction section, said second reaction section including a zone for destroying tar in the char bed and a second inlet for oxidizing gas;

a port for removing said combustible fuel gas from said apparatus; and means for controlling flow of said oxidizing gas through at least one of said first and second inlets; and means for removing solids from said second reaction section;

wherein said first and second inlets are operative to introduce oxidizing gas into said chamber with a substantially laminar or radial flow in a direction substantially perpendicular to said flow path.

10. The apparatus of claim 9, wherein said fuel inlet comprises said first inlet for oxidizing gas.

11. The apparatus of claim 10, further comprising an additional inlet for oxidizing gas.

12. The apparatus of claim 9, wherein said first inlet for oxidizing gas is separate from said fuel inlet.

13. The apparatus of claim 9, wherein said fuel inlet is adapted for inputting fuel gas in addition to said first air inlet.

14. The apparatus of claim 9, wherein said means for controlling flow is selected from flow restrictors, valves, control systems, and combinations thereof.

15. The apparatus of claim 9, wherein said second reaction section has dimensions selected to optimize tar destruction therewithin.

16. The apparatus of claim 9, wherein said second reaction section includes an inner wall, and said second inlet for oxidizing gas includes a slit in said inner wall.

17. The apparatus of claim 9, wherein said apparatus is operative to produce a combustible fuel gas product having a tar content less than about 100 ppm.

18. The apparatus of claim 9, wherein said apparatus is operative to produce a combustible fuel gas product having a solids content that is sufficiently low to permit use in an internal combustion engine.

19. The apparatus of claim 9, further comprising ignition means for initiating combustion in said firs reaction section.

20. A system for producing combustible fuel gas from a biomass fuel, the system comprising:

a solid particulate fuel supply subsystem;

a biomass fuel gasifier according to claim 9, wherein said gasifier is operative to receive particulate fuel from said fuel supply system; and a gas cooling and cleaning subsystem operative to receive combustible gas output from said biomass fuel gasifier and supply cooled and cleaned combustible gas, wherein said gas cooling and cleaning subsystem comprises means for cooling the output fuel gas to a temperature selected to prevent water condensation within said system.

21. The apparatus of claim 20, wherein said apparatus is operative to produce a combustible fuel gas product having solids content that is sufficiently low to permit use in an internal combustion engine.

22. The apparatus of claim 20, wherein said fuel supply system comprises means for size sorting particles of said fuel.

23. The apparatus of claim 20, wherein said fuel supply system comprises means for altering the particle size of said fuel.

24. The apparatus of claim 23, wherein said means for altering the particle size is selected from size producers, pelletizers, and combinations thereof.

25. The apparatus of claim 20, wherein said fuel supply system comprises means for drying said fuel.

26. The apparatus of claim 25, wherein said means for drying is operative to produce fuel having a water content less than or equal to about ten percent by weight.

27. The apparatus of claim 20, wherein said gas cooling and cleaning subsystem is operative to maintain gases at temperatures greater than or equal to about 30 degrees C. above the dew point of water.

28. The apparatus of claim 20, wherein said gas cooling and cleaning subsystem comprises means for cleaning said output fuel gas.

29. The apparatus of claim 28, wherein said means for cleaning comprises a continuously self-cleaning filter.

* * * * *